US007413083B2

(12) United States Patent
Belfance et al.

(10) Patent No.: US 7,413,083 B2
(45) Date of Patent: Aug. 19, 2008

(54) DESICCANT VIAL ASSEMBLY FOR EFFERVESCENT TABLETS

(75) Inventors: John Belfance, Amsterdam, NY (US); Ronald Supranowicz, Lenox, MA (US)

(73) Assignee: CSP Technologies, Inc., Amsterdam, NY (US)

( * ) Notice: Subject to any disclaimer, the term of this patent is extended or adjusted under 35 U.S.C. 154(b) by 0 days.

(21) Appl. No.: 10/219,570

(22) Filed: Aug. 15, 2002

(65) Prior Publication Data

US 2005/0016873 A1 Jan. 27, 2005

Related U.S. Application Data

(60) Provisional application No. 60/372,339, filed on Apr. 11, 2002.

(51) Int. Cl.
*B65D 1/00* (2006.01)
*B65D 83/04* (2006.01)
*F17C 11/00* (2006.01)

(52) U.S. Cl. ..... 206/540; 206/528; 206/204

(58) Field of Classification Search ..... 206/204, 206/535, 540, 591, 528, 585, 524.3, 524.4, 206/825; 215/228, 231

See application file for complete search history.

(56) References Cited

U.S. PATENT DOCUMENTS 567,488 A * 9/1896 Moehn ..... 206/535
1,671,285 A * 5/1928 Hanna ..... 206/535
2,711,840 A 6/1955 Gits et al.
2,814,404 A 11/1957 Towns
2,852,054 A 9/1958 Motley
3,282,477 A 11/1966 Henchert
3,470,930 A 10/1969 Jurczenia
3,592,349 A 7/1971 Baugh (Continued)

FOREIGN PATENT DOCUMENTS

DE 9412075 U 10/1994

(Continued)

OTHER PUBLICATIONS

Expert witness report of Dr. Steven J. Grossman Pursuant to Fed.R. Civ.P.26(b)(4)(a)(i)-Capitol Vial, INc. v. Triple S. Plastics, INc. dated Dec. 30, 1998.

*Primary Examiner*—J. Gregory Pickett
(74) *Attorney, Agent, or Firm*—Greenberg Traurig, LLP

(57) ABSTRACT

The present invention is directed to a one-piece vial assembly having a container and cap that provides a substantially moisture-free environment for effervescent tablets, and other items that require packaging and retention in a substantially moisture-free environment. In one embodiment, the container and cap are joined together by a hinge; hence the vial assembly is a one-piece assembly in which the cap is opened and closed in a "flip-top" arrangement. The vial assembly of the present invention includes a desiccant entrained plastic. In one embodiment, the desiccant entrained plastic is located in a desiccant sleeve, which surrounds at least a portion of the product within the vial assembly sleeve. In yet another embodiment, the sleeve surrounds the vial assembly interior with a thin-walled plastic so that the product contained within the vial assembly is completely surrounded by the desiccant entrained plastic sleeve. In another embodiment, the items contained in the vial assembly of the present invention are subjected to about fifty times less moisture when compared to a conventional stoppered vial.

4 Claims, 12 Drawing Sheets

U.S. PATENT DOCUMENTS

| | | | | | |
|---|---|---|---|---|---|
| 3,786,982 | A | | 1/1974 | Rakes et al. | |
| 3,826,358 | A | * | 7/1974 | Butler et al. | 206/204 |
| 3,833,406 | A | * | 9/1974 | White | 206/204 |
| 3,860,148 | A | | 1/1975 | Sherin | |
| 3,861,433 | A | | 1/1975 | Schier et al. | |
| 3,900,550 | A | | 8/1975 | Oliver et al. | |
| 3,910,740 | A | | 10/1975 | Rees | |
| 3,966,386 | A | | 6/1976 | Beyer-Olsen et al. | |
| 4,082,201 | A | | 4/1978 | Bittel | |
| 4,180,178 | A | | 12/1979 | Turner | |
| 4,204,824 | A | | 5/1980 | Paradis | |
| 4,244,479 | A | | 1/1981 | Smalley | |
| 4,298,036 | A | | 11/1981 | Horvath | |
| 4,351,630 | A | | 9/1982 | Hayberg et al. | |
| 4,377,247 | A | | 3/1983 | Hazard et al. | |
| 4,386,714 | A | | 6/1983 | Roberto et al. | |
| 4,420,089 | A | | 12/1983 | Walker et al. | |
| 4,422,998 | A | | 12/1983 | Sorenson | |
| 4,579,246 | A | | 4/1986 | Swearingen et al. | |
| 4,619,373 | A | | 10/1986 | Galer | |
| 4,655,363 | A | | 4/1987 | Neat | |
| 4,713,219 | A | | 12/1987 | Gerken et al. | |
| 4,717,034 | A | | 1/1988 | Mumford | |
| 4,754,656 | A | | 7/1988 | Charm | |
| 4,754,896 | A | | 7/1988 | Roltgen et al. | |
| 4,783,056 | A | | 11/1988 | Abrams et al. | |
| 4,801,011 | A | | 1/1989 | Desidoigts et al. | |
| 4,805,789 | A | * | 2/1989 | Lancesseur et al. | 215/6 |
| 4,807,425 | A | | 2/1989 | Abrams et al. | |
| 4,809,874 | A | | 3/1989 | Pehr | |
| 4,812,116 | A | | 3/1989 | Abrams et al. | |
| 4,813,570 | A | | 3/1989 | Pontoppidan | |
| 4,860,907 | A | | 8/1989 | Sondal | |
| 4,866,952 | A | | 9/1989 | Hight et al. | |
| 4,899,897 | A | * | 2/1990 | Buttiker et al. | 215/228 |
| 4,955,513 | A | | 9/1990 | Bennett | |
| 4,974,735 | A | | 12/1990 | Newell et al. | |
| 5,000,204 | A | | 3/1991 | Smith | |
| 5,012,941 | A | | 5/1991 | Abrams et al. | |
| 5,020,683 | A | | 6/1991 | Strassheimer | |
| 5,108,029 | A | | 4/1992 | Abrams et al. | |
| 5,114,003 | A | * | 5/1992 | Jackisch et al. | 206/204 |
| 5,133,470 | A | | 7/1992 | Abrams et al. | |
| 5,139,165 | A | | 8/1992 | Hara | |
| 5,147,054 | A | | 9/1992 | Pehr | |
| 5,169,374 | A | | 12/1992 | Abrams et al. | |
| 5,199,635 | A | | 4/1993 | Abrams et al. | |
| 5,219,320 | A | | 6/1993 | Abrams et al. | |
| 5,221,000 | A | * | 6/1993 | Lee | 206/204 |
| 5,269,430 | A | | 12/1993 | Schlaupitz et al. | |
| 5,270,011 | A | * | 12/1993 | Altherr | 215/237 |
| 5,429,699 | A | | 7/1995 | Abrams et al. | |
| 5,435,456 | A | | 7/1995 | Dubach | |
| 5,441,150 | A | | 8/1995 | Ma | |
| 5,474,177 | A | | 12/1995 | Abrams et al. | |
| 5,513,768 | A | | 5/1996 | Smith | |
| 5,575,399 | A | | 11/1996 | Intini | |
| 5,624,528 | A | | 4/1997 | Abrams et al. | |
| 5,638,957 | A | | 6/1997 | Brasier | |
| 5,667,094 | A | | 9/1997 | Rapchak et al. | |
| 5,718,347 | A | * | 2/1998 | Walker et al. | 215/209 |
| 5,723,085 | A | | 3/1998 | Abrams et al. | |
| 5,788,064 | A | * | 8/1998 | Sacherer et al. | 206/204 |
| 5,911,937 | A | * | 6/1999 | Hekal | 264/255 |
| 5,947,274 | A | * | 9/1999 | Taskis et al. | 206/204 |
| 6,050,400 | A | | 4/2000 | Taskis et al. | |
| 6,179,118 | B1 | * | 1/2001 | Garrill et al. | 206/204 |
| 6,194,079 | B1 | * | 2/2001 | Hekal | 206/204 |

FOREIGN PATENT DOCUMENTS

| | | |
|---|---|---|
| GB | 1533528 | 11/1978 |
| JP | 2001-88861 | 9/1999 |

* cited by examiner

SECT. A-A

DESICCANT VIAL ASSEMBLY FOR EFFERVESCENT TABLETS

RELATED APPLICATION

This is a continuation-in-part of application 60/372,339 filed Apr. 11, 2002.

FIELD OF THE INVENTION

The present application relates to a desiccant entrained plastic vial assembly for packaging and retaining effervescent tablets, which should be maintained in a substantially moisture-free environment until used by the end user. The present application also discloses methods for using the desiccant entrained plastic vial assembly.

BACKGROUND OF THE INVENTION

Effervescent tablets have been used to deliver drugs, vitamins and nutritional supplements, among other things (e.g. denture cleaners). These tablets quickly dissolve in water and are consumed in liquid form. In an attempt to keep the tablet environment moisture free, one method that is conventionally used are packaging the tablets in rigid two-piece containers with a stoppered cap. The container typically contains a sachet of silica gel desiccant to absorb moisture in the container over the shelf life. For highly moisture sensitive products, the tablets may be wrapped in foil, and additionally, may be placed in an aluminum container with a desiccant stopper cap. In another example, the effervescent tablets are packaged in foil/paper laminate packets.

It is desirable to provide a one-piece vial assembly having a container and cap that can provide a relatively moisture free environment for effervescent tablets, and other items that require packaging and retention in a relatively moisture free environment. It is also desirable to provide a one-piece vial assembly that is easier to open than existing containers and packaging. It is also desirable to provide packaging for effervescent containers that are relatively less voluminous when compared to packaging options that are currently available.

SUMMARY OF THE INVENTION

The present invention is directed to a interconnected vial assembly having a container and cap that provides a substantially moisture-free environment for effervescent tablets, beverage-forming tablets, and other items that require packaging and retention in a substantially moisture-free environment. In one embodiment, the container and cap are joined together by a hinge; hence, in this embodiment, the vial assembly is an interconnected assembly in which the cap is opened and closed in a "flip-top" arrangement. In another embodiment, the hinge is integral with the cap and container, which provides a one-piece vial assembly. The vial assembly of the present invention includes a desiccant entrained plastic. In one embodiment, the desiccant entrained plastic is located in a desiccant sleeve, which surrounds at least a portion of the product within the vial assembly sleeve. In yet another embodiment, the sleeve surrounds the vial assembly interior with a thin-walled plastic so that the product contained within the vial assembly is completely surrounded by the desiccant entrained plastic sleeve. In another embodiment, the items contained in the vial assembly of the present invention are subjected to about fifty times less moisture when compared to a conventional stoppered vial.

In a further embodiment, the vial assembly of the present invention can store a number of effervescent tablets, for example, 5 to 40 effervescent tablets, ranging in size from about 7 mm to about 36 mm in diameter and from about 6.2 mm to about 7.8 mm in thickness. In a further embodiment, the vial is dimensioned and sized to store 10 or 20 tablets having a size of about 25 mm in diameter and about 7 mm in thickness.

In yet another embodiment, the vial assembly contains a spring joined to the inner wall of the cap. The spring cushions the tablets. In another embodiment, the desiccant is positioned within the spring. In yet another embodiment, the structure of the spring retains a sachet containing a desiccant material. In yet another embodiment, the desiccant is positioned to surround the interior of the vial assembly and in the spring joined to the inner wall of the cap.

In yet another embodiment, a cushioning spring is positioned in the bottom of the container.

In another embodiment of the present invention, desiccant is located at the bottom of the container. In yet another embodiment, the dessicant located in the bottom of the container is positioned within a spring at the bottom of the container. In one embodiment, the desiccant is entrained within the plastic material that constructs the spring. In yet another embodiment, a sachet of desiccant is retained in the spring. In yet another embodiment, a false bottom or platform is provided at the bottom of the container, in which a desiccant entrained plastic is employed in the construction of these components. In yet another embodiment, a sachet of desiccant is retained by the false bottom or platform.

In yet further embodiments, combinations of the above possibilities are employed for locating a desiccant material within the container.

The vial assembly of the present invention may optionally include tamper-evident features and child resistant features. Other features may be included in the vial assemblies of the present invention and are discussed in "Detailed Description" section of this disclosure. These features are disclosed in pending U.S. patent application Ser. No. 09/710,330, filed Nov. 11, 2000, incorporated herein by reference.

In one embodiment, the container has an upper portion and an outer surface. The container has a rim at the upper portion. The upper portion of the container includes a flexible and detachable protrusion having a contact element and a break point. In another embodiment, the cap has a base with an outer periphery and a skirt extending perpendicularly and outwardly around the outer periphery of the base. The cap also has a hinge and a tab extending perpendicularly and outwardly from the skirt of the cap. In still another embodiment, the top has a least two slots capable of housing the protrusion. In yet another embodiment, the tab has a first slot and a second slot including an interlocking device for engaging with the protrusion.

In a further embodiment, when the container is in an empty state, the protrusion is positioned within the first slot. In still a further embodiment, when the container is in a filled stage, the cap is placed upon the container and the protrusion is repositioned within the second slot causing the contact element of the protrusion to engage the interlocking device of the second slot and thus to form a tamper-proof seal. For purposes of this invention, the term "empty stage" refers to a stage when the container is empty prior to filling, such as when the container is shipped by the manufacturer of the container to the site where items are placed inside the container. The term "filling stage" refers to a stage after the container has been filled with its content. In one embodiment, the contents may include effervescent tablets.

In yet another embodiment, the protrusion is formed in such a way that, if the cap is opened (i.e. tampered with), the protrusion will break off and thus, evidence of tampering with the container will be evident by the broken protrusion. It will be appreciated that it may not be possible to replace the protrusion once it has broken, since the protrusion is formed integrally with the container. Therefore, it should not be possible to defeat the tamper-proof capabilities by replacing the original broken protrusion. It will also be appreciated that the interlocked protrusion not only provides tamper-proof function, but also may aid in preventing dislodgement of the cap during transport.

For purposes of the present invention, the phrase "tamper-proof seal" means a visual indication that: (a) when not broken, the container's cap has not been opened; and (b) when broken, the container cap has been opened and thus, visually displays that the container was tampered with.

In another embodiment, the present invention relates to a method of tamper-proofing a container and a cap assembly by: (a) providing a container have an upper portion and an outer surface, the upper portion having a flexible and a detachable protrusion having a contact element and a break point; and a cap having a base with an outer periphery and a skirt extending perpendicularly and outwardly around the outer periphery of the base, the cap has a hinge and a tab extending perpendicularly and outwardly from the skirt of the cap, the tab comprising a first and second slot capable of housing the protrusion, the second slot having an interlocking device; (b) positioning the protrusion within the first slot in an empty stage; (c) opening the cap and filling the container; and (d) closing the cap upon the container and repositioning the protrusion within the second slot thereby allowing the contact element of the protrusion to engage the interlocking device to from a tamper-proof seal.

In yet another embodiment, the method further comprises applying a sufficient frontal, upward force upon the tab to allow the interlocking device of the slot to engage the contact element of the protrusion and thus to detach the protrusion from the flange at the break point to thereby breach the seal.

BRIEF DESCRIPTION OF DRAWINGS

A more complete appreciation of the present invention and many of the attendant advantages thereof will be readily understood by reference to the following description was considered in connection with the accompanying drawings in which.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various embodiments and features thereof.

DETAILED DESCRIPTION OF THE PRESENT INVENTION

Figure 1:
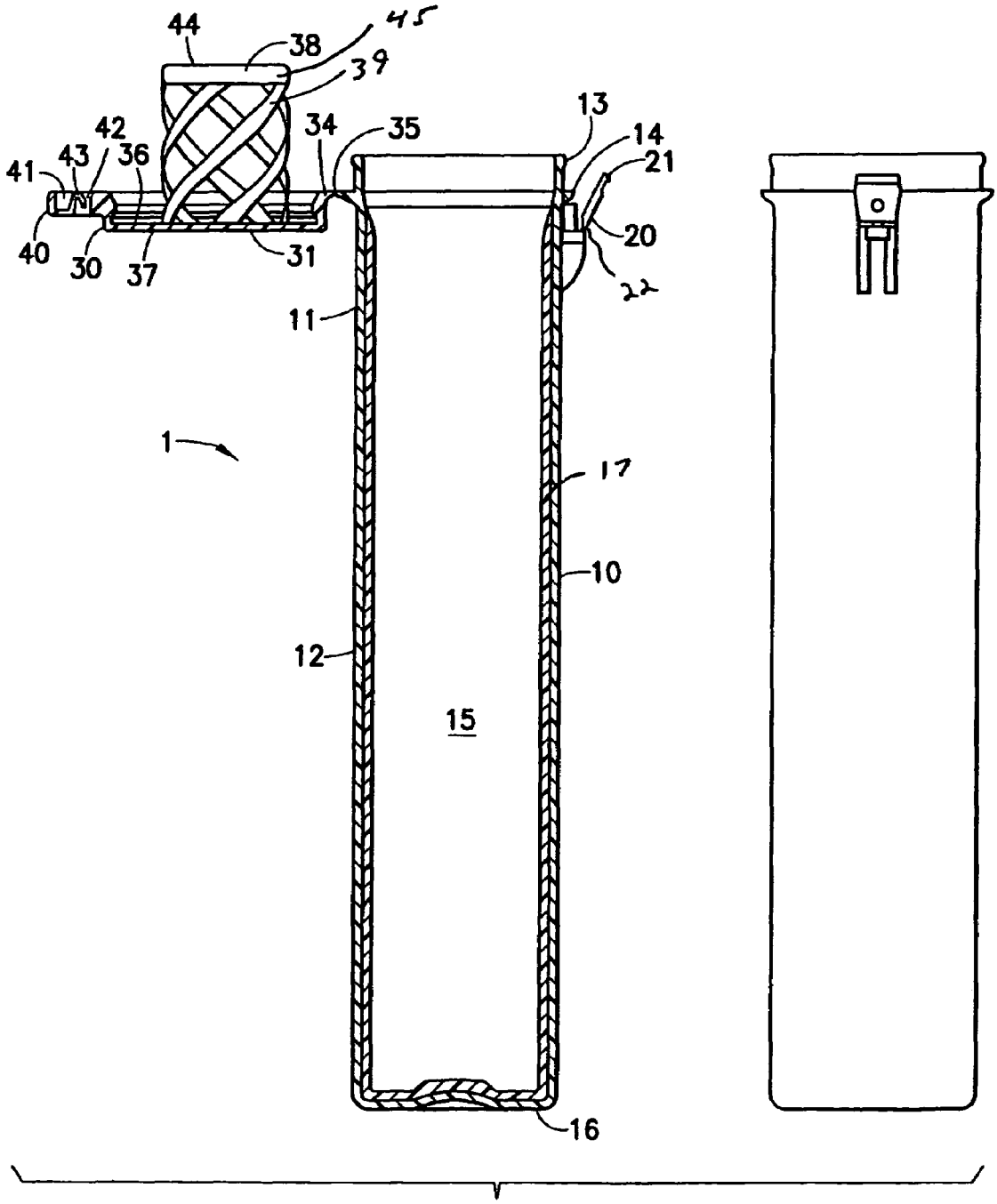
FIG. 1 is a longitudinal sectional view of one embodiment of the vial assembly of the present invention.

Referring now to the drawings wherein like references designate identical or corresponding parts throughout the several views, and more particularly to FIG. 1 wherein one embodiment of the one-piece vial assembly 1 of the present invention is illustrated. The assembly 1 comprises a container 10 having a base 16, or internal cavity 15, and outer surface 12 and an upper portion 11. Container 10 has an inner sleeve 17 constructed of desiccant-entrained plastic 17. The container 10 has a rim 13 at the upper portion 11. The container 10 also has a flange 14 extending radially outwardly from the outer surface 12 of the container 10. A detachable protrusion 20 with a contact element 21 and a break point 22 is located at or near flange 14. The assembly 1 also includes a cap 30 having a base 31. The cap 30 also has a tab 40 and a hinge 34. The tab 40 has a first and second slot 41 and 42 respectively, capable of housing the protrusion 20. The second slot 42 comprises an interlocking device 43.

The hinge 34 is also attached at or near the container flange 14. In one embodiment, the hinge 34 has a recess 35 that function as a binding point for ease of opening and closing of the container 10. While the figures depict the hinge 34 as integral with the cap 30 and container 10, the skilled artisan would readily appreciate that any king of hinge may be employed, such a hinge constructed of a plurality of components. For example, to name just one possibility, an arrangement can be provided where a hinge component of the cap is engaged with a hinge component of the container.

The base 31 of the cap 30 has an inner surface 36 and an outer surface 37. A spring element 38 is joined to the inner surface 36 of the base 31 of the cap 30. The spring element 38 is constructed of helical strands 39. In one embodiment, some of the helical paths extend clockwise, and/or others extend counterclockwise, so that the helical strands either intersect or do not intersect. The helical strands 39 are joined at a distal spring end 44 to a ring 45. Preferably, the spring element 38, that is, the helical strands 39 and the ring 45, is unitary in its construction.

In one embodiment of the present invention, the desiccant material is present only in the spring element. In yet another embodiment, the desiccant material is present only in the sidewalls of the container. In yet another embodiment, the desiccant material is present in both the spring element and the sidewalls of the container. In yet another embodiment, a desiccant-containing sachet is retained within the spring element 38.

Suitable material for vial assembly 1 includes plastic (e.g. thermoplastic, such as polypropylene and polyethylene). In an embodiment, the cap 30 (including spring element 38) and the container 10 may be integrally molded of the plastic to form a hinge 34 therebetween. In another embodiment, the cap 30 and the container 10 may be produced in a conventional molding process and, in still another embodiment, may be molded in accordance with the mold similar to that disclosed in U.S. Pat. Nos. 4,783,056 and 4,812,116 respectively. In a further embodiment, with such a process and mold, the assembly, including the cap, container, spring, and hinge may be produced in accordance with the operation disclosed in U.S. Pat. Nos. 4,783,056 and 4,812,116 or, in another embodiment, may be produced in accordance with U.S. Pat. No. 5,723,085 or 6,303,064. The disclosure of these patents are incorporated by reference herein.

Figure 2:
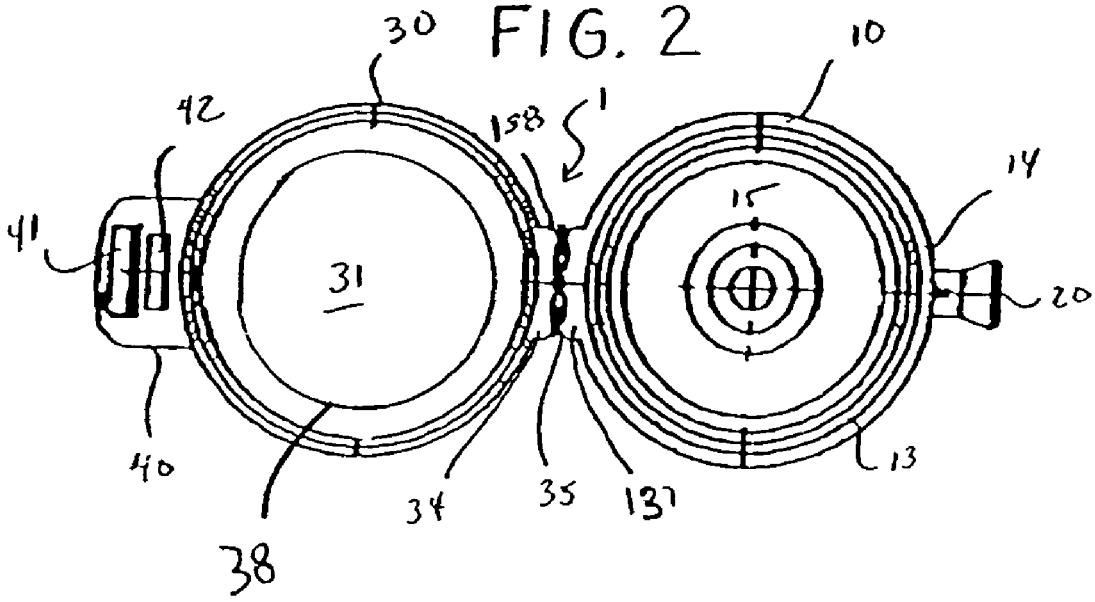
FIG. 2 is an overhead plan view of one embodiment of the vial assembly in an opened position.

FIG. 2 refers to an overhead plan view of the assembly 10 of the present invention in an opened position of one embodiment of the present invention. The assembly 10 includes the container 10 and the cap 30 connected by the hinge 34. The container 10 has the cavity 15, the rim 13 and the flange 14. The cap 30 includes the circular base 31 and the tab 40. The tab 40 includes a first slot 41 and second slot 42. The hinge 34 has a recess 35 and two elements, 137 and 138 respectively. The first element 137 is attached to the flange 14 of the container 10 and second element 138 is attached to the cap 30.

Figure 3:
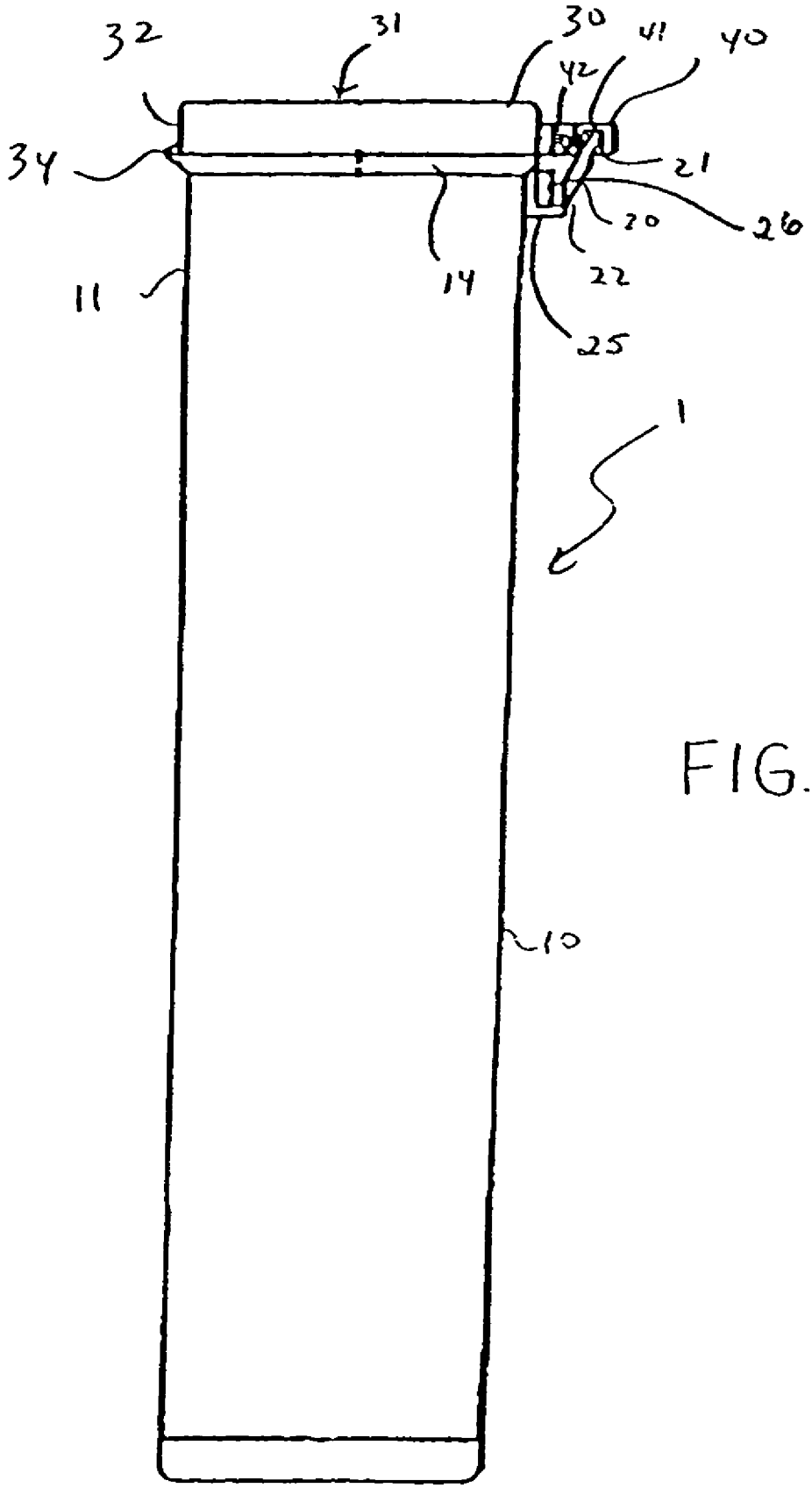
FIG. 3 is a side elevation view of one embodiment of the present invention of the vial assembly in an empty stage.
Figure 5:
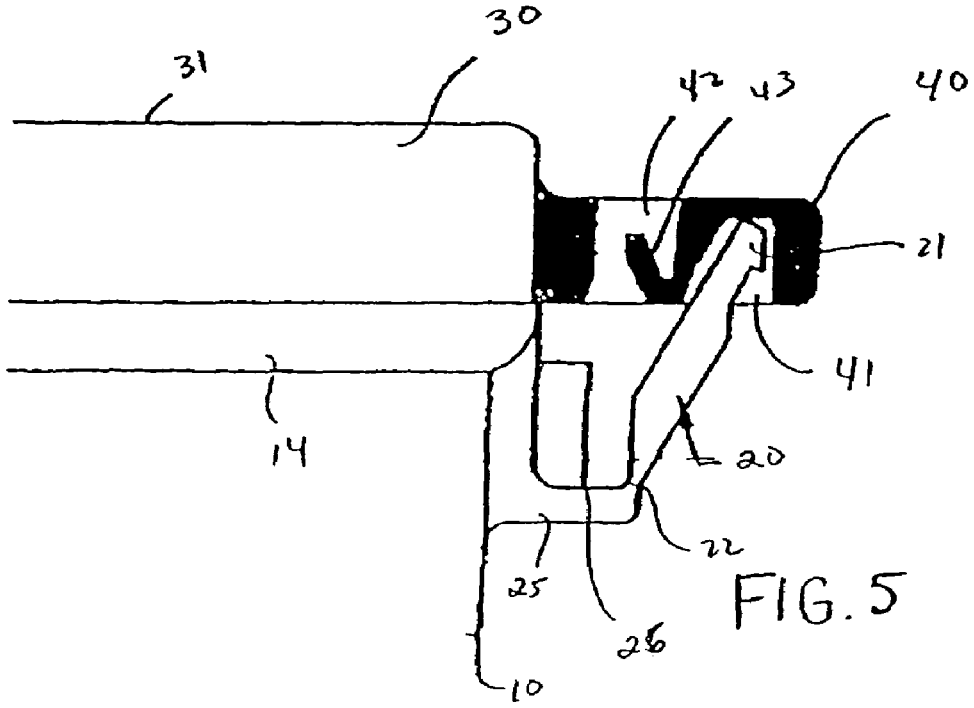
FIG. 5 is a blow-up of one embodiment of the present invention of the protrusion of the flange of the container in the empty stage.

FIG. 3 and FIG. 5 depict yet another embodiment of the present invention of the container and cap assembly 1 in the empty stage prior to filling with effervescent tablets or other items that should be packaged and stored in a substantially moisture-free environment. In one embodiment, the container 10 has a flange 14 which includes protrusion 20. In another embodiment, protrusion 20 is attached directly to container 10. The protrusion 20 has a u-shaped element 25. The protrusion 20 has a contact element 21 and a break point 22. In the empty stage, the contact element 21 of the protrusion 20 is situated in the first slot 41 of the top 40 of the cap 30. It is understood that other designs of first slot 41 are contemplated. The only design requirement of first slot 41 is that it serves the purpose of holding protrusion 20 in place during handling and prior to the filling stage. As such, protrusion 20 is protected from accidentally being torn off prior to engaging protrusion 20 with interlocking device 43. There is a space between the protrusion 20 and the stop rib 26 and the second slot 42 with the interlocking device 43 remaining empty.

Figure 4:
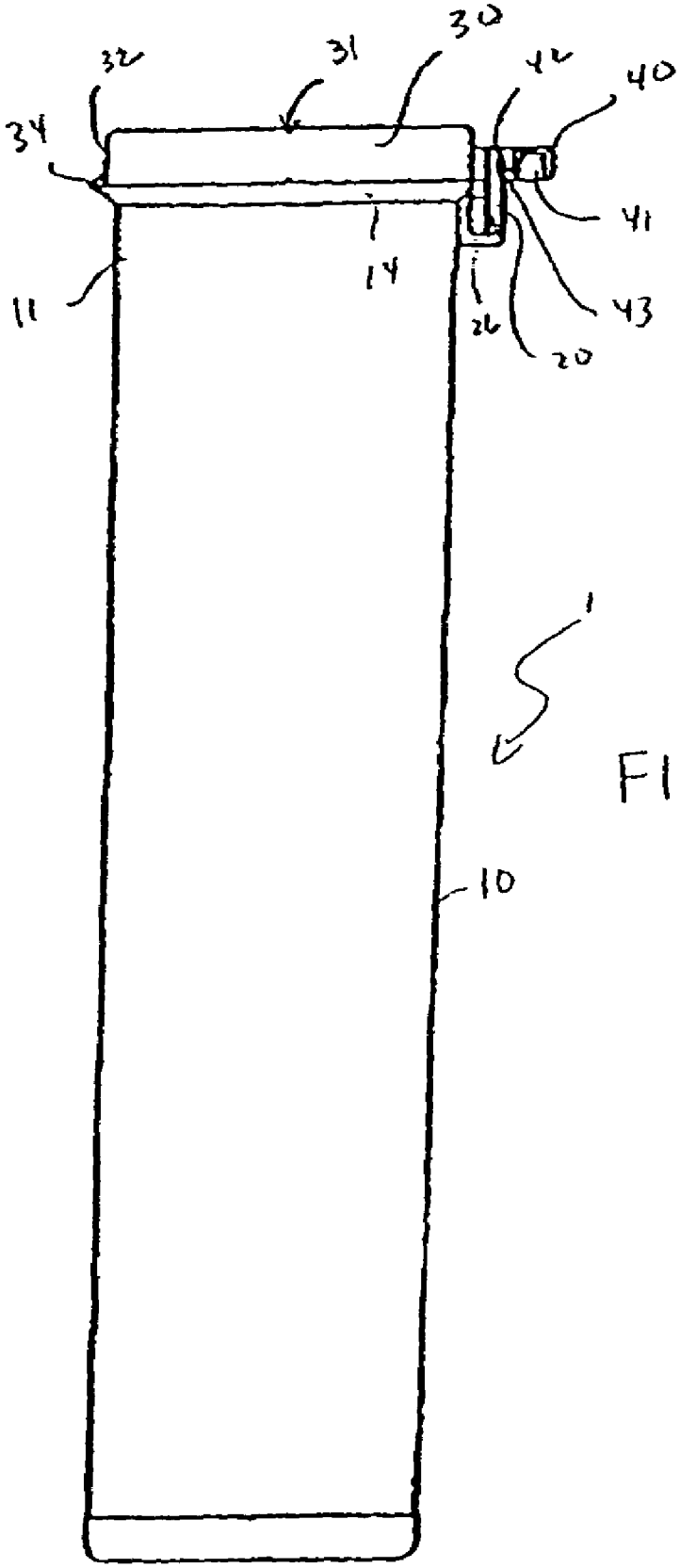
FIG. 4 is a side elevation view of one embodiment of the present invention of the vial assembly in a filled stage.
Figure 6:
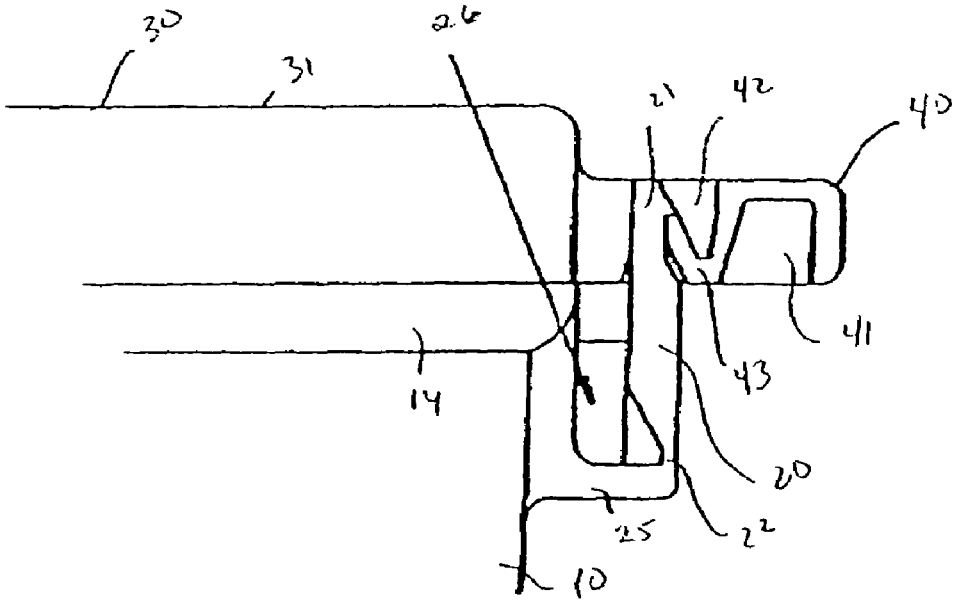
FIG. 6 is a blow-up of one embodiment of the present invention of the protrusion of the flange of the container in the filled stage.

FIG. 4 and FIG. 6 illustrate the vial assembly 1 of the present invention of an embodiment after it has been filled. The cap 30 is placed upon the container 10 and the protrusion 20 is repositioned with the second slot 42. The contact element 21 of the protrusion 20 engages the interlocking device 43 of the second slot 42 of the tab 40 to form a tamper-proof seal. The stop rib 26 restricts the movement of the protrusion 20.

Subsequently, in operation, a user would break the tamper-proof seal by applying sufficient frontal upward force to allow the interlocking device 43 of the second slot 42 to engage the contact element 21 of the second slot 42 and to engage the contact element 21 of the protrusion 20 to detach the protrusion 20 from the flange 14 at the break point 22.

It is understood that the design of break point 22 is such that, when sufficient frontal upward force is applied to the cap to open the vial assembly, the protrusion must fail (e.g. break) at break point 22 prior to any failure between the engagement of protrusion 20 with interlocking device 43. Consequently, in one embodiment, break point 22 width is sufficiently narrow to break when sufficient frontal upward force is applied to open the vial assembly while, at the same time, is sufficiently flexible and of suitable design to allow for: (a) protrusion 20 to be moved from the first slot to the second slot without breakage; and (b) protrusion 20 to remain engaged with interlocking device 43 while sufficient force is applied to open the vial assembly and break at break point 22.

Interlocking device 43 may be any design that is able to directly mate with protrusion 20 and remain engaged even when sufficient frontal force is applied to cause a break at break point 22. Such interlocking devices may include teeth, flexible projections and suitable wedge-like shapes.

Figure 7:
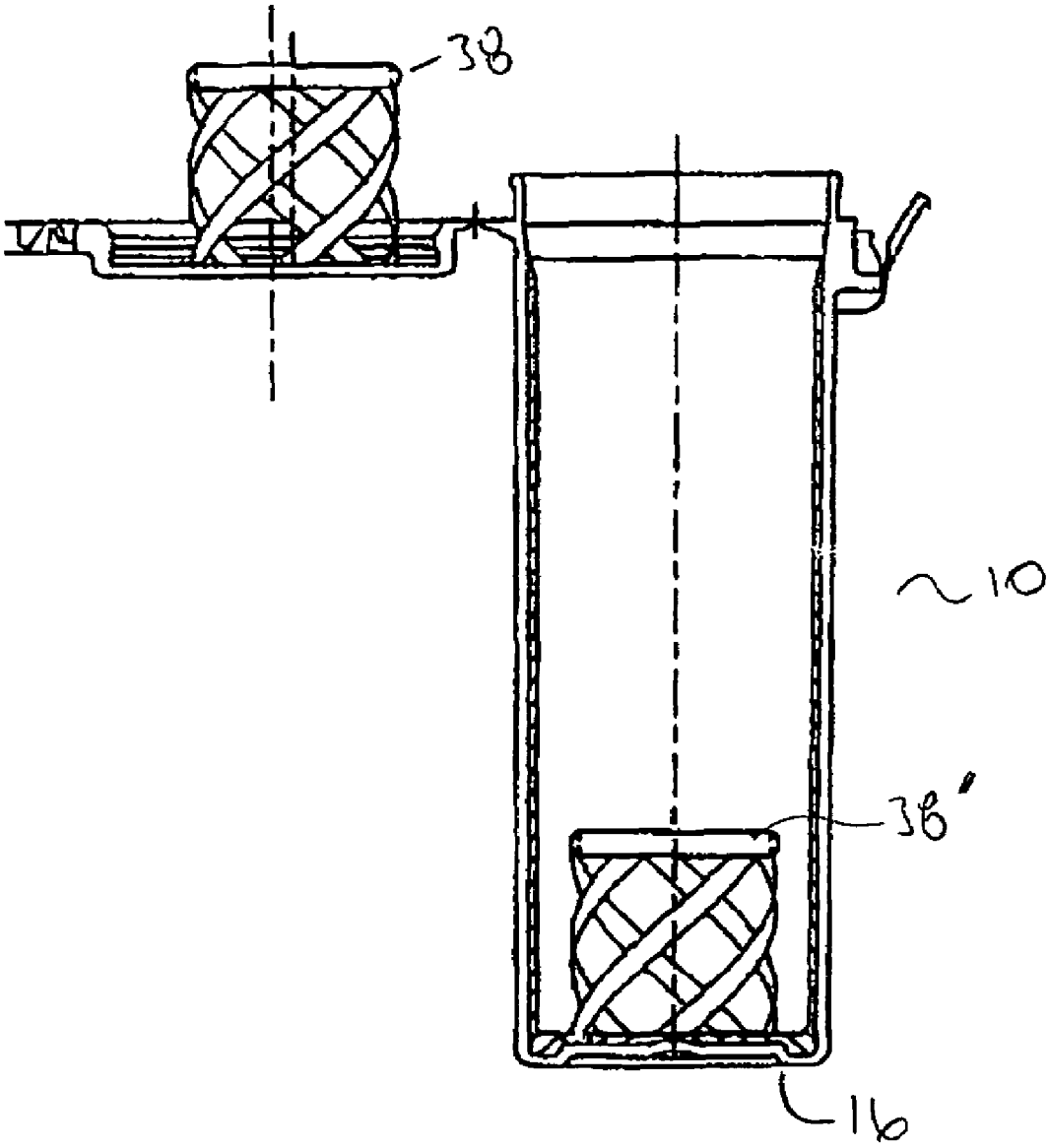
FIG. 7 is a side elevation view of another embodiment of the present invention of the vial assembly.

FIG. 7 shows an embodiment where springs 38, 38', are positioned on the inner side of the cap 30 and on the base 16 of the container 10. Spring 38' is can be structured in the same way as spring 38. The springs can be constructed of a desiccant-entrained plastic, or they may retain a desiccant-containing sachet, and combinations of these arrangements may also be provided. One of the springs may also be provided merely for cushioning the contents of the vial, to prevent breakage of the contents.

The bottom spring 38' may be placed in the bottom of the vial during the second part of a two-shot injection molding operation. The height adjustment is controlled by the spring length prior to compression and the end compressed height based on the number and weight of the tablets and the thickness of the strands 39.

Figure 8:
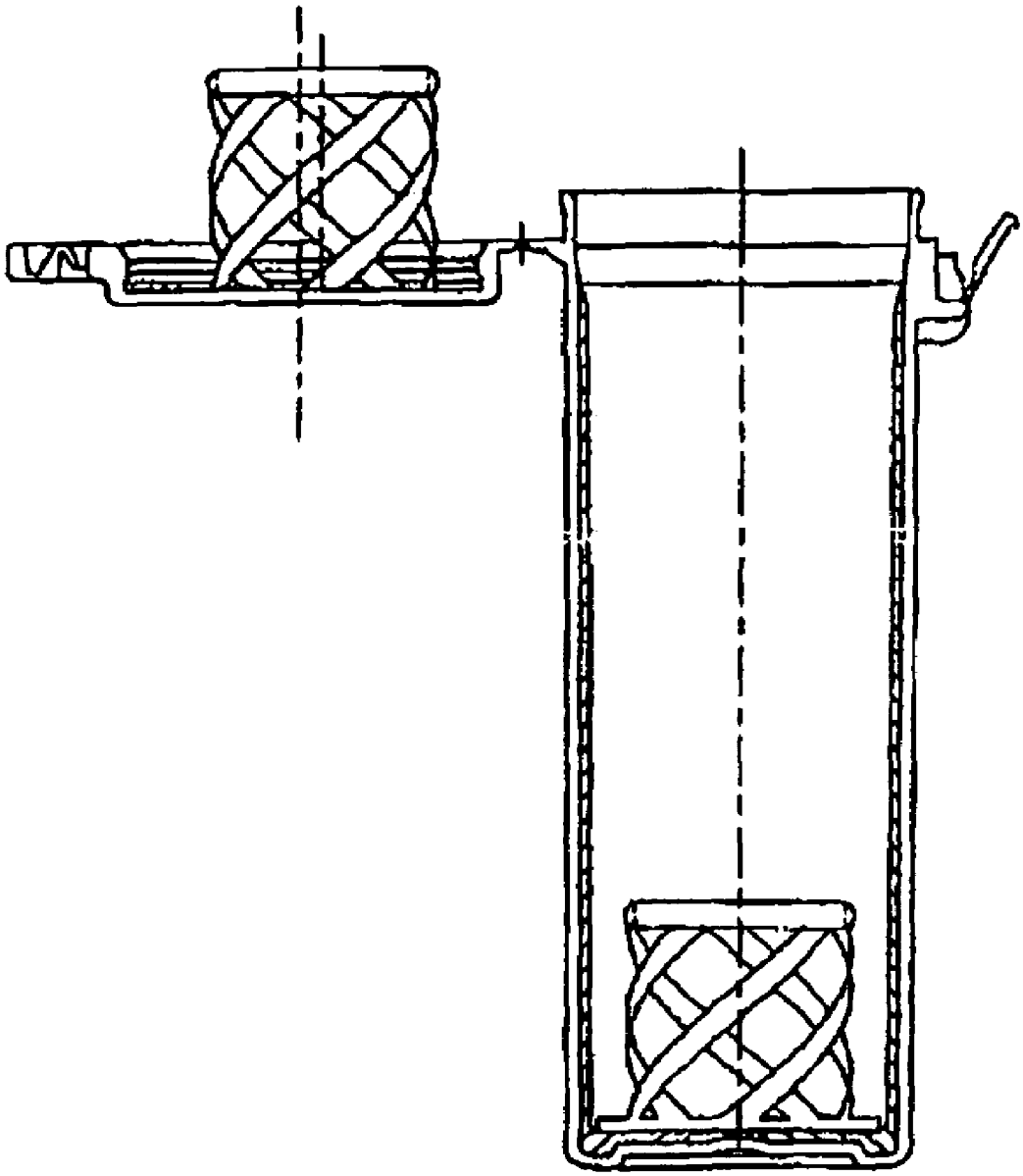
FIG. 8 is a side elevation view of another embodiment of the present invention of the vial assembly.

FIG. 8 depicts an arrangement similar to FIG. 7. However, here the bottom spring 38' is molded in a separate process. The spring is then loaded into the vial via mechanical means, such as loaded by a robot, prior to closing the cap. The spring 38' may be loaded in a post molding step, but this would require reopening the vial. The process could be fully automated, or accomplished manually. The springs can be constructed of a desiccant-entrained plastic, or they may retain a desiccant-containing sachet, and combinations of these arrangements may also be provided. One of the springs may also be provided merely for cushioning the contents of the vial, to prevent breakage of the contents.

Figure 9:
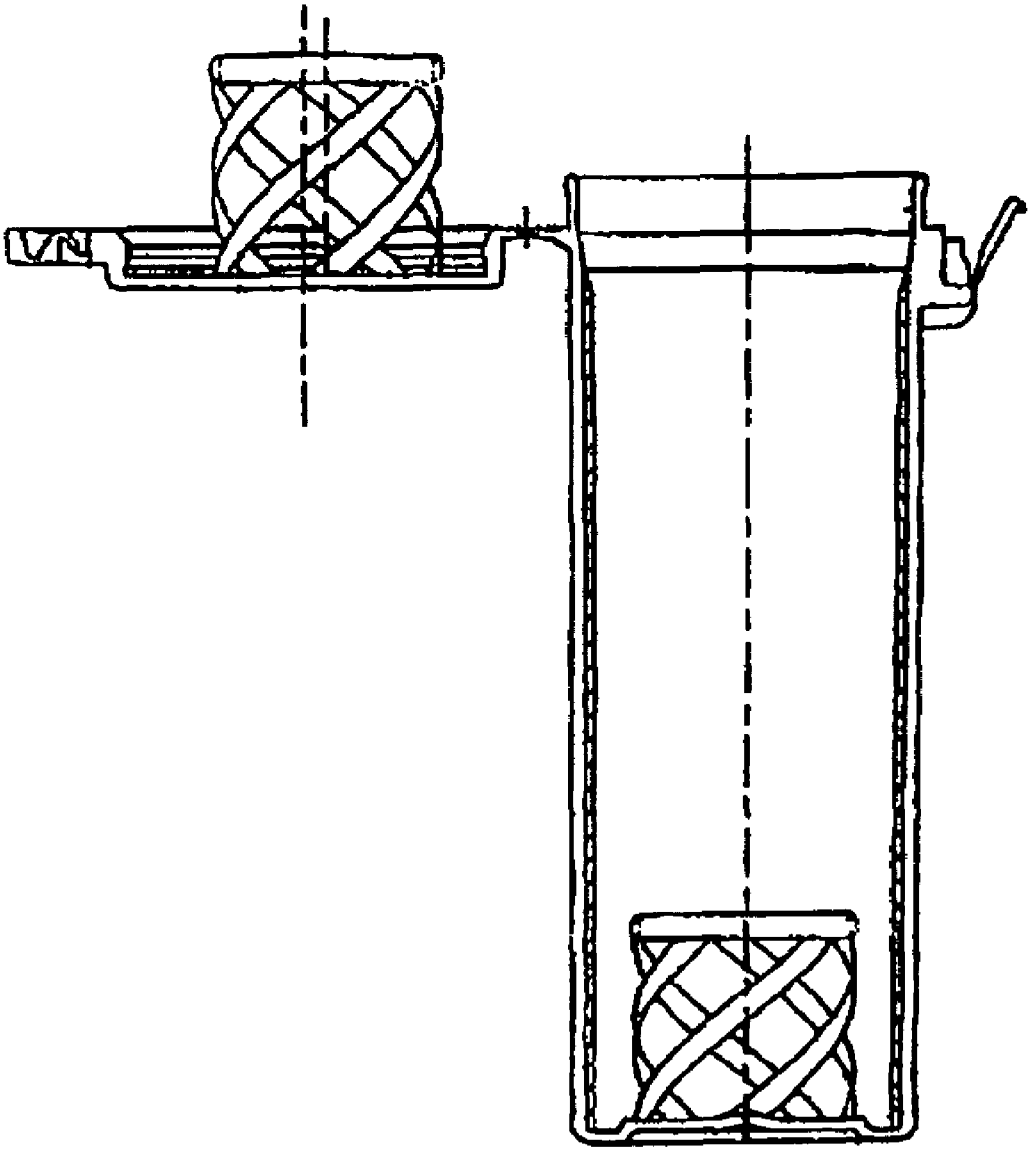
FIG. 9 is a side elevation view of another embodiment of the present invention of the vial assembly.

In FIG. 9, springs are positioned on the base 16 and cap 30 of the container 10. Here, an overmolding process is employed. A tube of desiccant is placed on the tall core of the mold, leaving the end of the core uncovered. The spring molding mechanism resides in the center of the tall core and these components are variable to create different spring lengths and helix web thicknesses for different tablet stack heights and weights. The springs can be constructed of a desiccant-entrained plastic, or they may retain a desiccant-containing sachet, and combinations of these arrangements may also be provided. One of the springs may also be provided merely for cushioning the contents of the vial, to prevent breakage of the contents.

Figure 10:
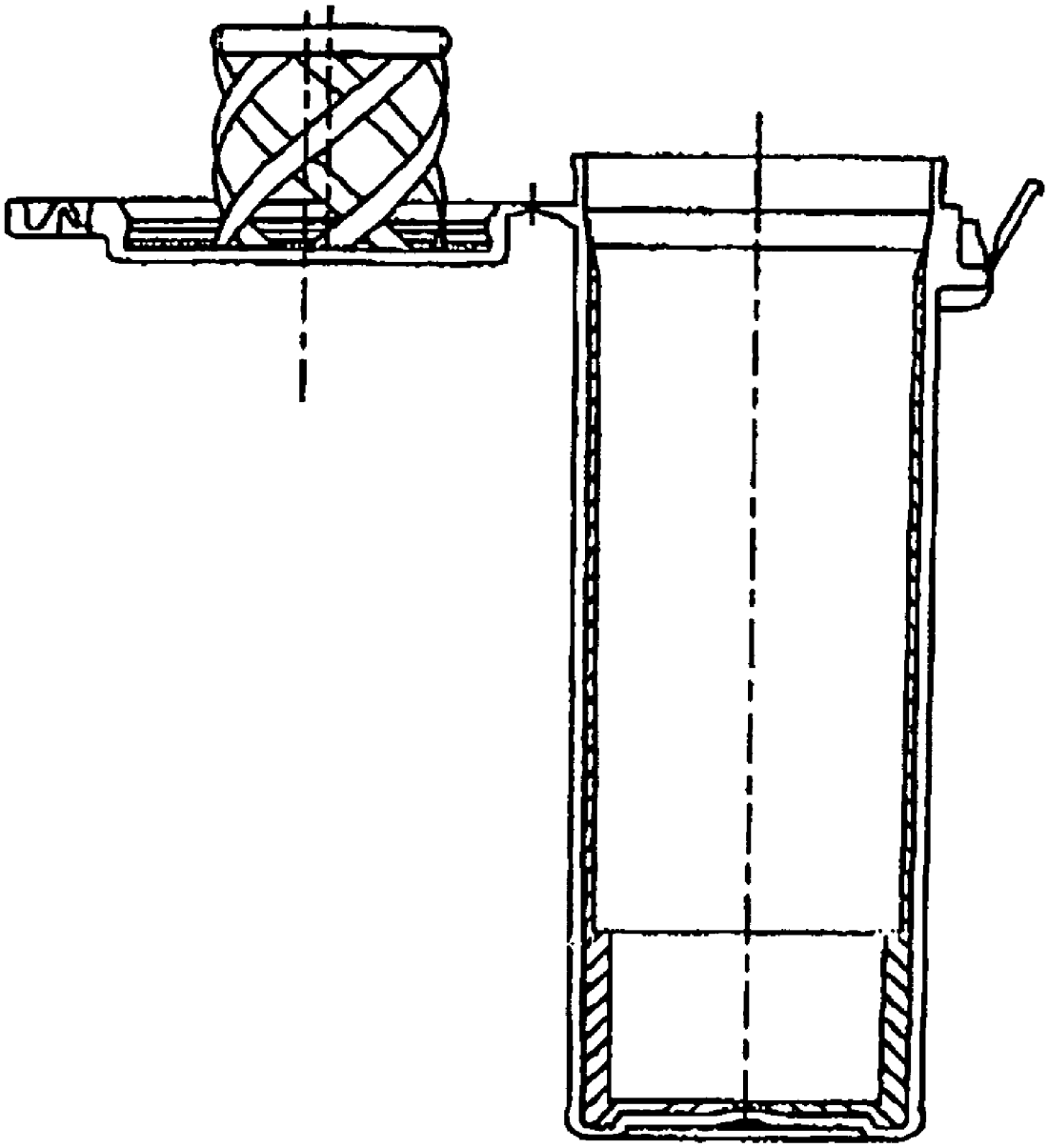
FIG. 10 is a side elevation view of another embodiment of the present invention of the vial assembly.

FIG. 10 shows yet another embodiment where an inner wall is positioned on the inside of the container. The inner wall reduces the inside diameter of the container, with the top of the inner wall providing a ledge on which the tablets or other item stored in the container can rest. The height of the ledge can be varied to produce a number of different heights. This arrangement can be provided by a two-piece tall core with a screw on replaceable end that can account for the numerous variations in height, which can account for varying thicknesses in tablets. The inner wall can be constructed of a desiccant entrained plastic.

Figure 11:
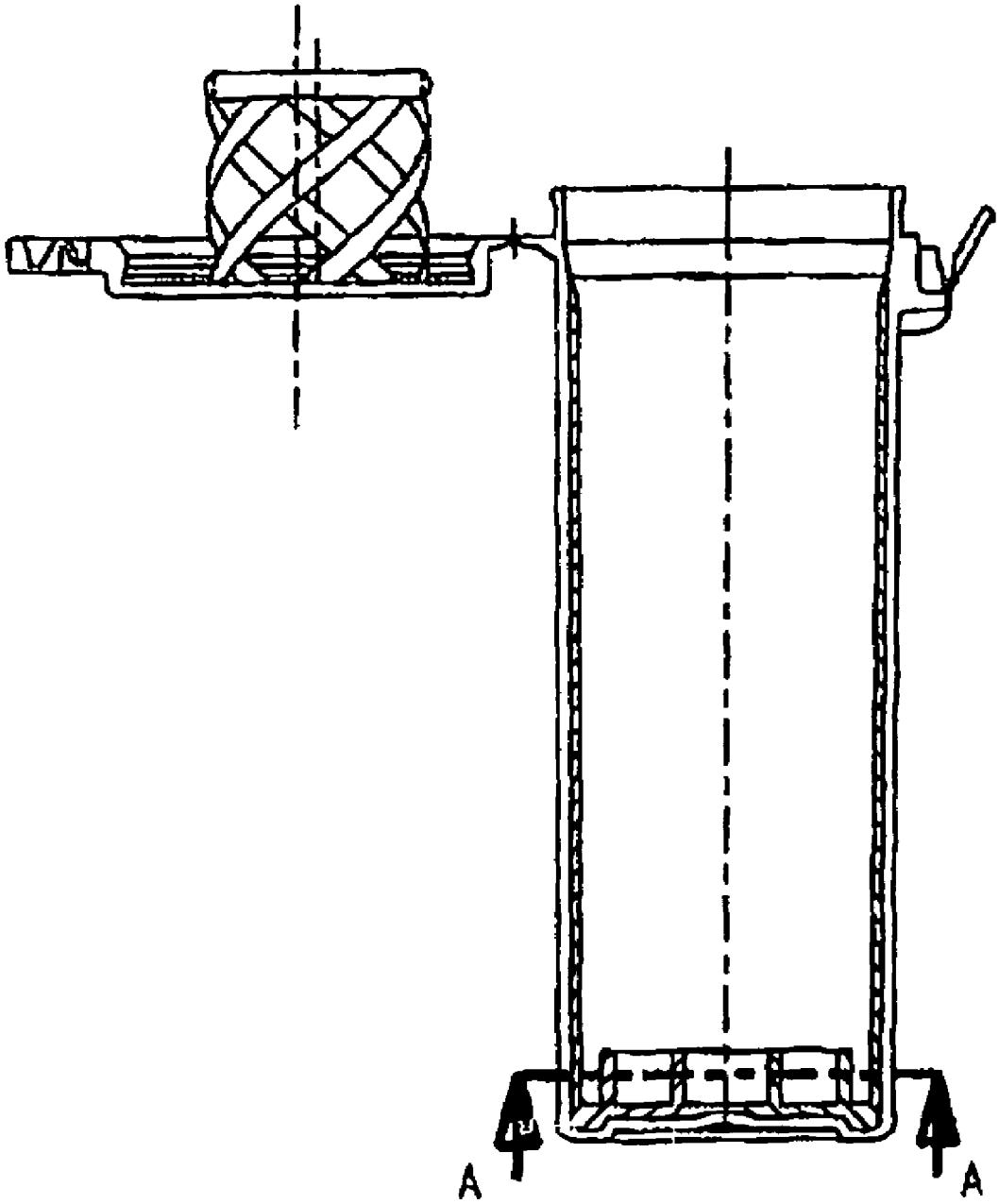
FIG. 11 is a side elevation view of another embodiment of the present invention of the vial assembly.
Figure 12:
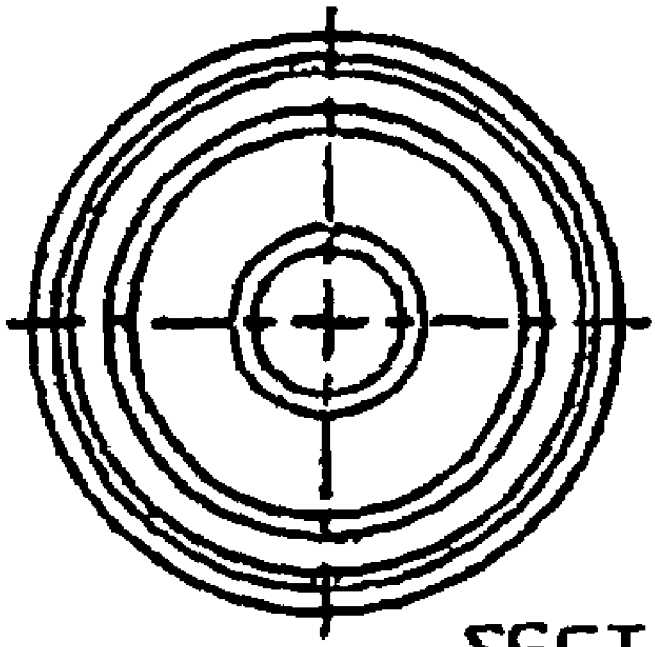
FIG. 12 is a view along line A-A, as shown in FIG. 11.

FIGS. 11 and 12 show another embodiment in which concentric rings are formed onto the base of the container in a two shot molding process. Alternatively, the rings are formed in an overmolding process. The height of the rings is determined by a two-piece plastic core that has a replaceable end that has different ring depths machined into it. The rings can be formed of a desiccant-entrained plastic.

Figure 13:
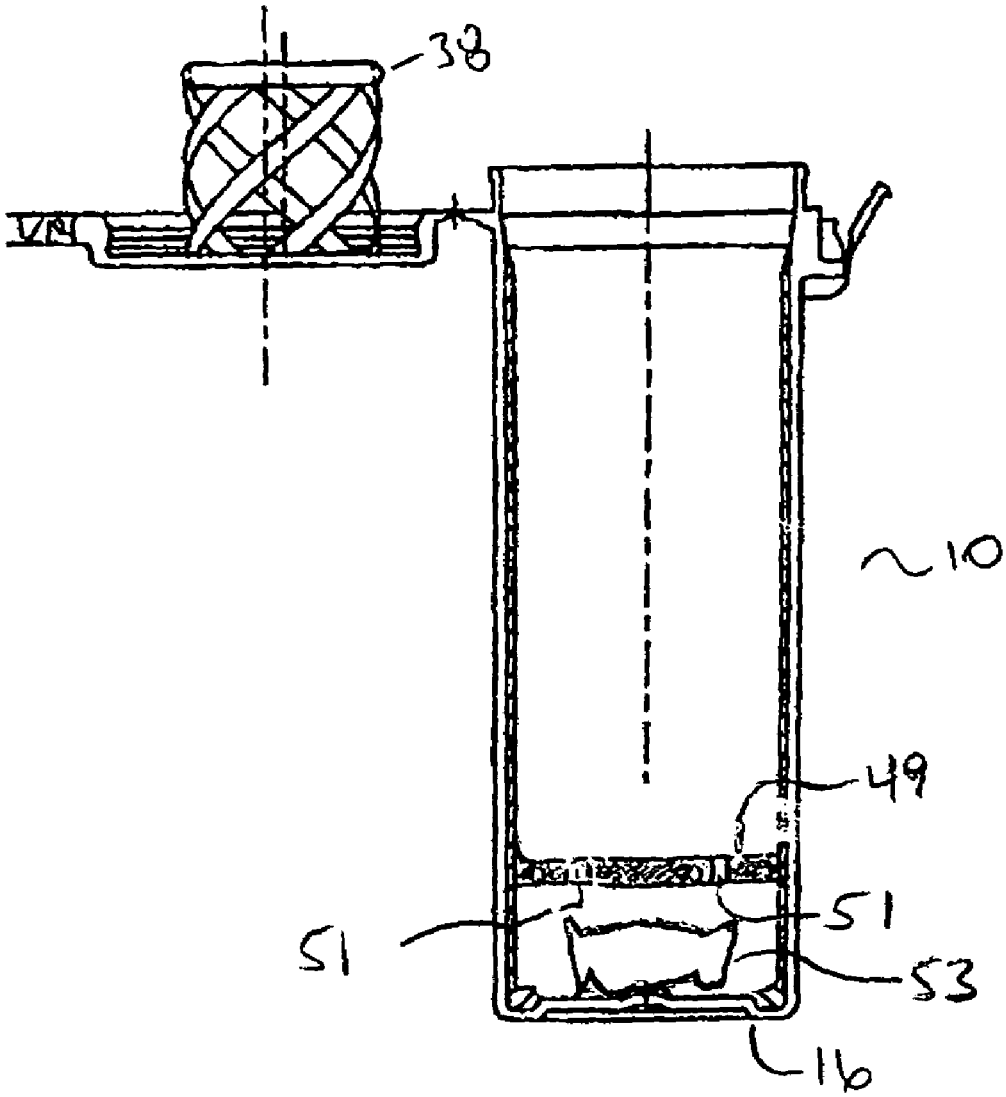
FIG. 13 is a cross sectional view of another embodiment of the present invention.

FIG. 13 shows another embodiment in which a false bottom is positioned above the base of the container. A desiccant-containing sachet 53 is positioned in the space between the false bottom and the base. Throughbores 51 are positioned in the false bottom so that moisture can be absorbed by the desiccant. Alternatively, a screen is employed in lieu of the false bottom. The false bottom or screen may be constructed of a desiccant entrained plastic.

The embodiments of the present invention provide a one-piece vial assembly with an attached cap. When the vial assembly cap is opened, the cap is not misplaced. It is also contemplated that, by making the cap integral with container, the time the vial is left open by a user should be a shorter period of time when compared to a two-piece vial construction, such as a container with a screw-off cap. Consequently, ensuring that the cap is closed at all times, except when it is necessary to have it open, is useful in maintaining product integrity of a moisture-sensitive product.

In yet another embodiment, the vial assembly of the present invention is provided with an "easy-to-close" cap design. That is, the vial assembly is specifically designed to be in one of only two states: (1) open and (2) completely closed. The closure arrangement is designed so that the cap cannot be partially closed or cross-threaded. If the cap does not seal properly, it should pop up. Also, in yet another embodiment, the cap is designed so it can be closed with one hand. Thus, the user should be able to close the cap from any position with respect to the hinge (front, side or back of vial assembly). In addition to the present application, pending U.S. patent application Ser. No. 09/386,702 describes this arrangement and is incorporated herein by reference.

It is further believed that, compared with stoppered vials, the embodiments of the present invention may require a lower opening force to open the cap of the vial assembly. In one example, the cap requires approximately ⅓ to ½ the force required to open a conventional stoppered vial. Pending U.S. patent application Ser. No. 09/386,702 describes this arrangement and is incorporated herein by reference.

In yet another embodiment, the vial assembly of the present invention are provided with a leak-proof and moisture tight seal. The vial assembly design, which includes closing the cap in the mold, ensures a leak proof and low moisture ingress seal. In one example, the vial assembly of the present invention has a moisture ingress rate of less than <250 μg/day. In another embodiment, this relatively low ingression rate, coupled with the desiccant entrained plastic within the vial assembly, ensure a managed and controlled environment for the times stored within the vial assembly.

In a further embodiment, the vial assembly of the present invention maintains seal performance after repeated lid openings and closings. For example, the seal maintains a low ingression rate after repeated lid openings/closings. In one specific example, the seal maintains its low moisture ingress performance after 50 cycles of lid openings and closings. U.S. Pat. Nos. 4,812,116, 4,807,425 and 5,723,085, as well as pending U.S. patent application Ser. No. 09/386,702, filed Aug. 31, 1999, and European patent document no. EP 625 948, describe examples of embodiments of the sealing arrangement. These references are incorporated herein by reference.

In one embodiment, the vial assembly of the present invention includes a desiccant entrained plastic. In one example, the desiccant entrained plastic is located at or near the cap (e.g. the spring element may be made of the desiccant entrained plastic and/or interior of the spring element may contain the desiccant entrained plastic). In yet another example, the desiccant entrained plastic is a sleeve that surrounds the items stored and packaged within the vial assembly. The sleeve covers at least partially the interior of the vial (e.g. surrounds the vial assembly interior with a thin-walled plastic so that the product contained within the vial assembly is surrounded by the desiccant sleeve). In another example of the use of vial, after the vial assembly is represented by opened and closed, the desiccant entrained plastic sleeve re-establishes the low relative humidity environment inside the vial assembly in a short period of time (e.g. in as low as less than about one minute).

The desiccant entrained plastic contains a desiccant such as silica gel or molecular sieve as the desiccant. Depending on the application, such as the application intended by the end user, molecular sieve or silica gel desiccant can be provided in the sleeve. For example, molecular sieve can be used for applications that require a low RH (e.g. less than <10% RH) maintained over the shelf life. In another example, silica gel can maintain a RH of 10-30% over a two year shelf life.

Suitable desiccant entrained plastic include these desiccant plastics disclosed in U.S. Pat. Nos. 5,911,937, 6,214,255, 6,130,263, 6,080,350 and 6,174,952, 6,124,006, 6,221,446 and U.S. Ser. No. 09/504,029, filed Feb. 14, 2000. By varying the desiccant loading and channeling agent in the plastic formulation, the overall moisture capacity and uptake rate of the desiccant entrained plastic can be controlled. These references are incorporated herein by reference.

In another embodiment, in addition to providing an embodiments that exhibit moisture absorption properties, the plastic may be entrained with other absorbing, releasing or activation components. U.S. Pat. Nos. 6,174,952, 6,177,183 6,194,079, 6,316,520, 6,124,006, 6,221,446 and U.S. Ser. No. 09/504,029 describe these kinds of arrangements and are incorporated herein by reference.

In one embodiment, the vials may be manufactured by the process described in U.S. Pat. Nos. 4,812,116 and 4,807,425 that are incorporated by reference herein. By closing the vial assembly lid inside the mold insures a clean, an aseptic environment inside the vial assembly may be maintained. Other examples of method of producing the vial include, but are not limited to, U.S. Pat. No. 5,723,085 and 6,330,064 that are incorporated by reference herein.

In yet another embodiment, a child resistance feature may be incorporated into the vial assembly. An example of such an arrangement is disclosed in pending U.S. patent application Ser. No. 09/641,203, filed Oct. 3, 2000, which is incorporated herein by reference.

In another embodiment, a tamper evidence feature that is molded into the vial assembly may be employed. An example is achieved with a two-position, breakaway tab that is disclosed in pending U.S. patent application Ser. No. 09/710,330, incorporated herein by reference. The tab is engaged during vial assembly filling, and the tab is ejected from the vial assembly when first opened by the user. This type tamper evidence feature is an alternative to shrink-wrapping the lid and container body, which also may be used.

In a further embodiment, the features of the present invention may be manifested in a variety of vial assembly designs, including but not limited to designs having non-cylindrical vial assembly shapes.

Numerous modification and variations of the present invention are possible in light of the above discussion.

It will be appreciated that many modifications and other variations that will be appreciated by those skilled in the art within the intended scope of this invention without departing from the teachings, spirit and intended scope of the invention.

We claim:

1. An integral injection molded plastic cap and container assembly, comprising:

a plastic container having sidewalls, the container closed at a bottom end and open at an upper end;

a plastic cap having a base with an outer periphery and a skirt extending perpendicular to the base, the cap further having an inside and an outside surface;

a plastic hinge attached to the container and to the cap at a first end of the cap and a first end of the container to form an integral injection molded plastic container and cap assembly;

a plastic spring element that is plastic injection molded to the inside surface of the cap, wherein the spring element is configured to pass by a portion of the sidewalls opposite the hinge when the cap is pivoted open and closed;

a moisture tight seal formed around the skirt of the cap and an outside of the sidewalls of the container so that, when the cap is in the closed position, the seal maintains a moisture ingress rate of less than 250 micrograms/day.

2. The integral injection molded plastic cap and container assembly of claim 1 further comprising:

a tamperproof seal.

3. The integral injection molded plastic cap and container assembly of claim 1 further comprising:

a desiccant sleeve attached to at least a portion of an inside of the container's sidewalls.

4. The integral injection molded plastic cap and container assembly of claim 1 further comprising:

a desiccant retained in the spring element.

* * * * *